US008347791B1

(12) United States Patent
Gray et al.

(10) Patent No.: US 8,347,791 B1
(45) Date of Patent: Jan. 8, 2013

(54) COMPUTER KEYBOARD AND MOUSE TRAY ASSEMBLY

(75) Inventors: William Gray, Topanga, CA (US); Allen Chance, Marina del rey, CA (US)

(73) Assignee: Ergo Genesis, LLC, Navasota, TX (US)

( * ) Notice: Subject to any disclaimer, the term of this patent is extended or adjusted under 35 U.S.C. 154(b) by 137 days.

(21) Appl. No.: 12/925,701

(22) Filed: Oct. 27, 2010

Related U.S. Application Data

(60) Provisional application No. 61/255,471, filed on Oct. 27, 2009.

(51) Int. Cl.
*A47B 23/00* (2006.01)

(52) U.S. Cl. ..... 108/42; 297/150; 297/153

(58) Field of Classification Search ..... 108/42, 108/44, 45, 49, 152, 50.01, 50.02; 297/150, 297/148, 145, 115, 116, 153, 188.15, 188.18, 297/188.2, 188.21, 188.14
See application file for complete search history.

(56) References Cited

U.S. PATENT DOCUMENTS

| | | | | | |
|---|---|---|---|---|---|
| 187,680 | A * | 2/1877 | Taylor | 297/150 |
| 3,121,591 | A * | 2/1964 | Micciche | 297/153 |
| 3,369,839 | A * | 2/1968 | Telarico | 297/150 |
| 3,408,032 | A * | 10/1968 | Francis | 248/450 |
| 4,591,206 | A * | 5/1986 | Pribble | 297/148 |
| 5,050,929 | A * | 9/1991 | Gueringer et al. | 297/145 |
| 5,246,240 | A * | 9/1993 | Romich et al. | 280/304.1 |
| 5,393,124 | A * | 2/1995 | Neil | 297/411.35 |
| 5,588,663 | A * | 12/1996 | Rundle et al. | 280/304.1 |
| 5,899,526 | A * | 5/1999 | LaPointe et al. | 297/173 |
| 6,027,165 | A * | 2/2000 | Adkins | 297/188.18 |
| 6,045,179 | A | 4/2000 | Harrison | |
| 6,354,658 | B1 | 3/2002 | Sher et al. | |
| 6,685,264 | B2 * | 2/2004 | Mullen et al. | 297/173 |
| 6,702,373 | B2 | 3/2004 | Rossko | |
| 6,722,681 | B1 * | 4/2004 | Large | 280/304.1 |
| 6,773,060 | B2 | 8/2004 | Sher et al. | |
| 7,065,319 | B1 | 6/2006 | Hartley | |
| 7,131,688 | B2 | 11/2006 | Steenson | |
| 7,293,751 | B2 * | 11/2007 | Eriksson | 108/43 |
| 7,367,618 | B2 | 5/2008 | Rossini | |
| 7,726,732 | B1 * | 6/2010 | Keating | 297/170 |
| 7,862,111 | B2 * | 1/2011 | Steenson | 297/161 |
| 2004/0206277 | A1 | 10/2004 | Roziere | |
| 2006/0103180 | A1 | 5/2006 | Brown | |
| 2008/0073946 | A1 | 3/2008 | Maione | |

OTHER PUBLICATIONS

Karl Pfleger's Armrest Mounted Split Keyboard Setup, 9 pages, Internet Printout, Aug. 2000.
MOBO Installation Instructions, 4 pages, Internet Printout, Jul. 13, 2009.

* cited by examiner

*Primary Examiner* — Jose V Chen
(74) *Attorney, Agent, or Firm* — Roger N. Chauza, PC

(57) ABSTRACT

A computer accessory tray assembly adapted for mounting to a chair. The tray assembly includes individual left and right mouse trays mounted by horizontal arms to respective arms of the chair. A keyboard tray is engageable with the left and right mouse trays to prevent lateral movement of the keyboard tray, but allows the keyboard tray to be lifted up from engagement with both mouse trays and moved out of the entry/exit position of the chair so that the user can have access to the chair. When removed from engagement from both mouse trays, the keyboard tray can be stowed by hanging it from either of the mouse trays. The mouse trays are adjustable vertically, forwards and backwards, and can be titled to provide ergonomic access to a mouse resting on either mouse tray.

20 Claims, 10 Drawing Sheets

COMPUTER KEYBOARD AND MOUSE TRAY ASSEMBLY

CROSS REFERENCE TO RELATED APPLICATIONS

This non-provisional patent application claims the benefit of pending U.S. provisional patent application Ser. No. 61/255,471 filed Oct. 27, 2009, entitled "Ergonomic Keyboard and Mouse Tray."

BACKGROUND

1. Technical Field

The present invention generally relates to computer accessories, and in particular to a tray assembly adapted for supporting a computer keyboard tray and one or more accessory trays, where the tray assembly is mountable to a chair, and the computer keyboard tray is easily removed and separated from other accessory trays to allow easy access to the chair.

2. Description of the Related Art

Computers of all types are necessary for both personal and business purposes. Desk top computers can be found in about every home and office to carry out routine communications as well as provide computational functions. Software is available for the many types of computers to provide almost any function, including word processing, tax preparation, bookkeeping, billing, mathematics, etc. The desk top computer generally involves the use of a monitor or display, a separate keyboard and often a mouse, all electrically connected to the computer via wires or by wireless means. In contrast, a laptop computer integrates the display, the keyboard and the mouse function into the unit itself, although many laptop computers can be operated by a separate mouse and/or keyboard.

In the office environment, and in many homes, desk top computers and laptop computers are supported on a table or desk, as are the associated keyboard and mouse. This arrangement functions well, but is often not ergonomically efficient. In many situations, the keyboard is too high or low with respect to the user who is seated in a chair. Should the person shift or turn in the chair, especially when the chair swivels, when answering a telephone or speaking to another person, then the keyboard and mouse may no longer be in an ergonomically comfortable range of the user.

The problem of maintaining the computer accessories, such as the keyboard and mouse, within the ergonomic range of the user, there are available various tray arrangements that fasten to the chair so that the computer accessories can be laid on the tray. In this manner, when the swivel chair moves, the tray and computer accessories move with the chair. In addition, the trays are mounted to chairs by various arrangements so that the tray is adjustable to and away from the user, up and down with respect to the user's arms, and can swivel about a horizontal axis to allow the tray and accessories laid thereon to be tilted for easy and comfortable use.

Many of the trays known in the prior art mount to a single arm of a chair. U.S. Pat. Nos. 7,065,319; 7,131,688 and published patent applications 2006/0103180; 2004/0206277; and 2008/0073946 illustrate trays of such type. This has the advantage that the tray can be swung out and away from the seat of the chair to allow the user to be seated, or to get up out of the seat without the tray impeding such action. The disadvantage of the single mounting arm for a tray is that it becomes unstable and prone to inadvertent movement should it be bumped by the user, or if an object such as a coffee cup, book or tablet is laid on the tray next to the keyboard. In addition, it is difficult to construct such an arm for the tray that is both swiveled about the arm of the chair, but yet remains stable when swung in front of the chair and used by the user.

Other tray configurations are designed to be fastened to both arms of a chair, including those disclosed in U.S. Pat. Nos. 6,045,179; 6,354,658 and 6,773,060. While the dual supported tray provides enhanced stability, as both sides of the tray are fastened to the respective arms of the chair, the movement of the tray out of the way to enter or exit the chair becomes more difficult and complicated. In some designs, the entire tray and support arms must be removed from the chair to sit in the chair. Such structure becomes more complicated and less adapted for easy use by the user. When one has to remove the tray from the chair, then the computer accessories often must also be removed from the tray. It can be seen that this type of accessory tray is less attractive to the user, and is often more costly.

It can be seen from the foregoing that a need exists for a computer accessory tray that is supported by both arms of a chair, but is nevertheless easy to be moved out of the way to sit in the chair. It can be seen that a need exists for a computer accessory tray that has support arms that are rigidly fastened to the chair arms to enhance stability to the tray. Another need exists for a computer accessory tray that is mounted to both arms of a chair by rigid, non-swivel supports, but nevertheless allows easy displacement of the tray to allow access to the chair by the user. Another need exists for a computer accessory tray that is rigidly mounted to the arm supports of a chair, but where the tray is adjustable to provide ergonomic use of the computer accessories laid on the trays.

BRIEF SUMMARY

In accordance with the principles and concepts of the invention, disclosed is a computer keyboard and mouse tray assembly that is mounted to a chair. The assembly includes a mouse tray attachable by a horizontal arm to each chair arm. Each mouse tray is spaced apart such that a user can gain entry or exit from the chair between the mouse trays. A keyboard tray loosely fits onto the spaced-apart mouse trays, and engages therewith so as to be laterally stable, but can be lifted and removed. Once removed from the spaced-apart mouse trays, the keyboard tray can be stowed in a position hanging from one of the mouse trays.

The mouse trays each include an upwardly extending lip, and the keyboard tray includes on opposing side edges thereof a downwardly depending lip. The keyboard tray can be lowered on to the spaced-apart mouse trays so that the lips engage and provide the lateral stability. The upwardly extending lips of each mouse tray include a notch, and the underside of the keyboard tray includes a hang knob. The keyboard tray can be hung from either of the mouse trays by engaging the hang knob in one of the mouse tray notches.

The mouse trays are adjustable in many ways to provide ergonomic operation of items placed on the mouse trays as well as on the keyboard tray. The assembly is adjustable forwards and backwards by extension or retraction of the horizontal arms that fasten to the arms of the chair. The entire assembly can be removed from the chair by removing the horizontal arms from respective bracket fixtures fastened to the chair arms. The mouse trays are adjustable vertically with respect to the chair arms, and can be tilted at various angles to provide the desirable ergonomic operation of the mouse or items resting on the mouse trays. In addition, each mouse tray is rotatable about an offset axis to effectively move the keyboard tray sideways a certain extent, or to adjust the spacing between the mouse trays.

According to an embodiment of the invention, disclosed is a computer accessory tray apparatus mountable to a chair. The apparatus includes a keyboard tray adapted for holding a computer keyboard thereon, and at least one accessory tray adapted for holding a computer mouse thereon. A first and second horizontal arm attaches the computer accessory tray apparatus to the chair, and the accessory tray is attachable to the first horizontal arm. The keyboard tray has one end removably engageable with the accessory tray and another end removably engageable with the computer accessory tray apparatus so that the keyboard tray is supported at opposing ends to prevent substantial lateral movement of the keyboard tray, but the keyboard tray can be lifted and removed from engagement therewith. The keyboard tray can thus be moved to allow entry to or exit from the chair by a user of the computer accessory tray apparatus.

According to another embodiment of the invention, disclosed is a computer accessory tray apparatus mountable to a chair, which includes a keyboard tray adapted for holding a computer keyboard thereon, and a first tray and a second tray. Each of the first and second trays is adapted for holding respective items thereon, and each first and second tray is adapted for rotation about respective vertical axes to adjust a spacing therebetween. Further included is a first and second horizontal arm, where the first tray is attached to the first horizontal arm, and the second tray is attached to the second horizontal arm. The keyboard tray has opposing lateral ends, where a first opposing end of the keyboard tray is removably engaged with the first tray so that the keyboard tray is supported, and a second opposing end of the keyboard tray is removably engaged with the second tray so that the keyboard tray is supported. When the first and second opposing ends of the keyboard tray are supported on the first and second trays, substantial lateral movement of the keyboard tray is prevented with respect to the first and second tray, but the keyboard tray can be lifted from engagement with the first tray and the second tray. Thus, the keyboard tray can be removed from the computer accessory tray apparatus to allow entry to or exit from the chair by a user.

According to yet another embodiment of the invention, disclosed is a computer accessory tray apparatus adapted for mounting to arms of a chair, including a first and second horizontal support arm having respective first and second ends, and computer accessory tray apparatus mounted to the first end of each of the first and second horizontal support arms. A first bracket fixture is fixed to a first arm of the chair by screws so as to be rigidly fixed thereto. The first bracket fixture has a slot therein adapted for slideably receiving therein the first horizontal arm, and the first horizontal arm can be slideably removed from the first bracket fixture. A second bracket fixture is fixed to a second arm of the chair by screws as to be rigidly fixed thereto; and the second bracket fixture has a slot therein adapted for slideably receiving therein the second horizontal arm, and the second horizontal arm can be slideably removed from the second bracket fixture. A friction mechanism is located in the respective slots of the first and second bracket fixtures to provide sliding friction to movement of the first and second horizontal arms when moved within the respective first and second bracket fixtures.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION

Figure 1:
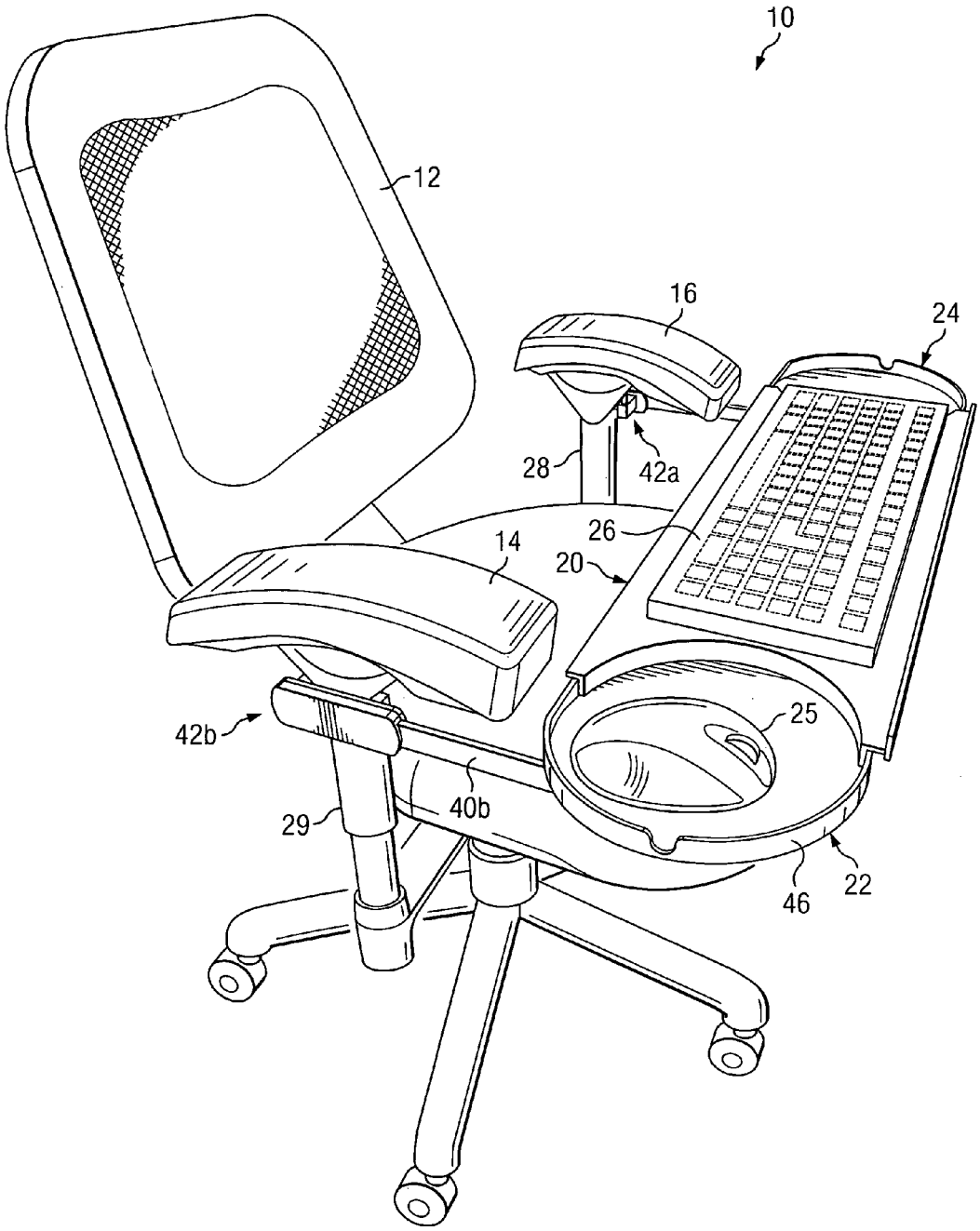
FIG. 1 is an isometric view of an office chair to which a keyboard and mouse tray assembly is mounted, according to one embodiment.
Figure 2:
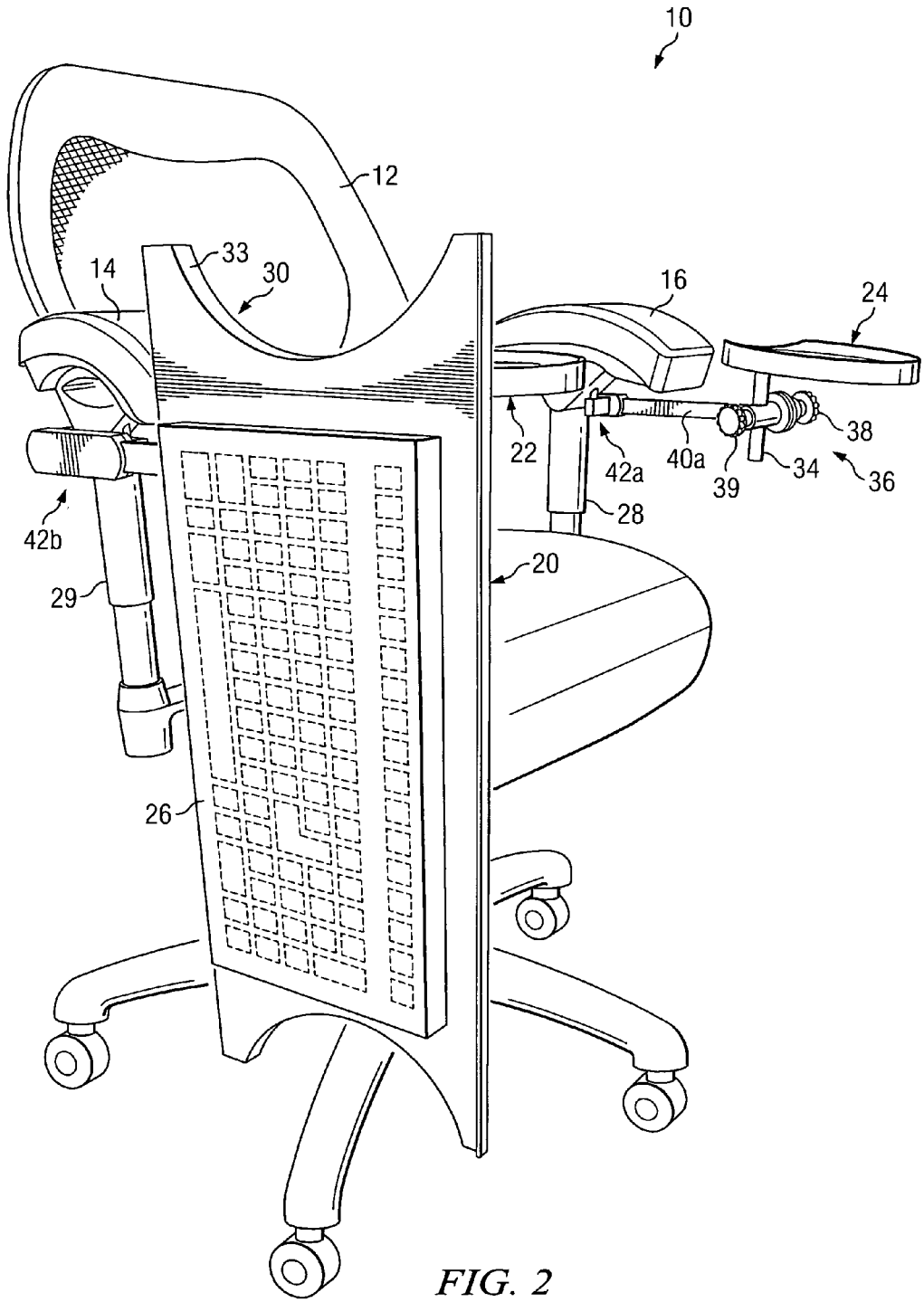
FIG. 2 is an isometric view of an office chair with the keyboard tray moved to a stowed position and hung on the mouse tray.

FIGS. 1 and 2 illustrate the computer keyboard and mouse tray assembly 10 as attached to an office chair 12. The keyboard and mouse tray assembly 10 can be mounted to many other types of chairs, other than an office chair. The office chair 12 illustrated includes a pair of arm rests 14 and 16 mounted to the underside of chair seat 18 by respective rigid upright supports 28 and 29. The keyboard and mouse tray assembly 10 is attached to respective horizontal arms 40*a* and 40*b*, which are fastened to the respective rigid upright supports 28 and 29 of the arm rests 14 and 16. As such, the keyboard and mouse tray assembly 10 is supported at both side ends thereof and thus is stable and can hold an assortment of computer accessories, as well as other items, including a laptop computer, mouse, drink cups, tablets, books, portable lamp, etc.

The keyboard and mouse tray assembly 10 according to one embodiment includes a center keyboard tray 20, a right-hand mouse tray 22 and a left-hand mouse tray 24. The right-hand mouse tray 22 is illustrated holding a wireless mouse 25 thereon. The keyboard tray 20 is constructed with a size to hold a standard keyboard 26 thereon. The keyboard tray 20 is removable from the right-hand mouse tray 22 and the left-hand mouse tray 24, by lifting up on the keyboard tray 20 and disengaging the same from the right and left mouse trays 22 and 24. As such, the user can easily remove the keyboard tray 20 to gain access to the chair 12, or to stand up and exit the chair 12. The positions of the right and left mouse trays 22 and 24 are not disturbed when the keyboard tray 20 is lifted and removed. While not shown, the keyboard 26 can be removably fastened to the keyboard tray 20 using various types of fasteners, including the hook and loop strips well known in the art, or can be fixed to the keyboard tray 20 using an adhesive or screws. When fastened to the keyboard tray 20, the computer keyboard 26 can be moved therewith when placed in a stowed position, such as shown in FIG. 2.

In FIG. 2, the keyboard tray 20 is illustrated in a stowed position, i.e., hung from the right mouse tray 22. The computer keyboard 26 is removably fastened to the keyboard tray 20 and thus remain attached thereto when in the stowed position. As can be seen, with the keyboard tray 20 in the stowed position, the front of the chair 12 is not obstructed with apparatus, and can thus be easily accessed by the user. This is especially the case when the keyboard 26 is of the wireless type where no wires or electrical cables extend from the keyboard 26 to the computer (not shown). Since the respective positions of the mouse trays 22 and 24 are not disturbed when the keyboard tray 20 is stowed, the mouse equipment and/or other items resting on the respective trays 22 and 24 need not be removed therefrom. The manner in which the keyboard tray 20 is suspended from either the right mouse tray 22, or the left mouse tray 24, is described in detail below. The right and left designations described herein are from the perspective of a user sitting in the chair 12.

The left mouse tray 24 is illustrated in FIG. 2 attached to the left chair upright arm support 28. The keyboard tray 20, as well as the right and left mouse trays 22 and 24, are constructed of a thermo-moldable or injection moldable plastic, or other suitable material. The various components can also be constructed by machining, cast or stamped from metal, or combinations thereof. The apparatus for fastening the right and left mouse trays 22 and 24 to the respective upright arm supports is constructed of aluminum that is polished, but can be constructed of many other metals or synthetic materials. The right and left mouse trays 22 and 24 are generally round, as shown in FIG. 1. The keyboard tray 20 is generally horizontally planar, and rectangular in shape, but with semicircular cutouts formed at each end thereof. A left cutout 30 is illustrated in FIG. 2 and the bottom view of FIG. 9, and a similar cutout 32 is formed in the right side of the keyboard tray 20. As used herein, the term semicircular includes arced partial semicircular shaped. The keyboard tray 20 is formed with downwardly depending lips around the semicircular cutouts. The left cutout 30 is illustrated with downwardly depending lip 33. The right cutout 32 is formed with a similar downwardly depending lip 31. The right and left mouse trays 22 and 24 are formed with a circumferential upright lips therearound to prevent items from sliding off the respective trays. The upwardly extending lip 48 is shown formed substantially around the left mouse tray 24, and the right mouse tray 22 is similarly formed with upwardly extending lip 46.

Fastened to the underside of the left mouse tray 24 is a downwardly depending stub 34 that fits into an adjustable bore 78*a* of an adjustment mechanism 36. The adjustment mechanism 36, shown in FIGS. 3 and 10, includes an outside knob 38 for fastening the adjustment mechanism 36 to the horizontal support arm 40*a*. The outside knob 38 also allows the left mouse tray 24 to be tilted, or rotated about an axis aligned with the threaded part 106 of the outside adjustment knob 38. An inside adjustment knob 39 can be tightened to maintain the left mouse tray 24 in a desired vertical position, or loosened to adjust the position of the left mouse tray 24 vertically. The vertical adjustment of the mouse trays 22 and 24 also provides a corresponding vertical adjustment of the keyboard tray 20. It will be described in more detail below that the mouse tray stub 34 is preferably fastened in an offset position, and not centered to the underside of the mouse tray 24. However, the stub 34 can be fastened in many locations to the underside of the left mouse tray 24. The stub 34 is fastened to the underside of the mouse tray 24, using a long screw 37, shown in FIG. 6.

The adjustment mechanism 36 has fastened thereto the horizontal arm 40*a* which extends to the upright support 28 of the chair arm rest 16. At the rear end of the horizontal arm 40*a* is a bracket fixture 42*a* that is fastened to the upright arm support 28 by screws or other type of fasteners. With this arrangement, the horizontal arm 40*a* of the left mouse tray 24 is substantially rigid and sturdy to prevent undesirable movement thereof, as well as to prevent movement of the mouse tray 24 and the keyboard tray 20. The horizontal arm 40*a* is constructed of metal so as to be slideable in the bracket fixture 42*a* to move the keyboard and mouse tray assembly 10 closer to, or further away from the chair 12. The right mouse tray 22 is mounted to the right upright arm support 29 in a similar manner.

Figure 3:
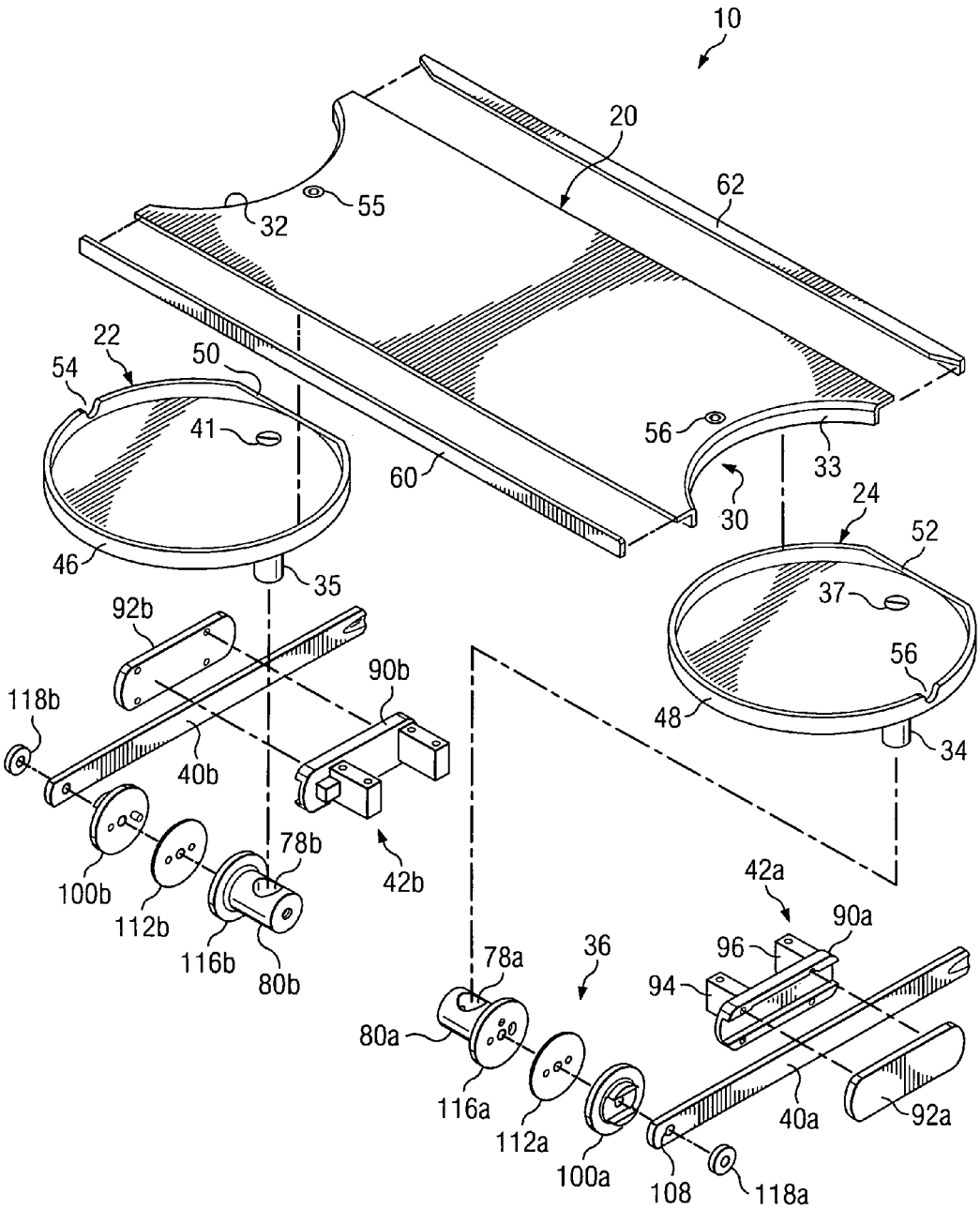
FIG. 3 is an exploded view of the keyboard and mouse tray assembly.
Figure 9:
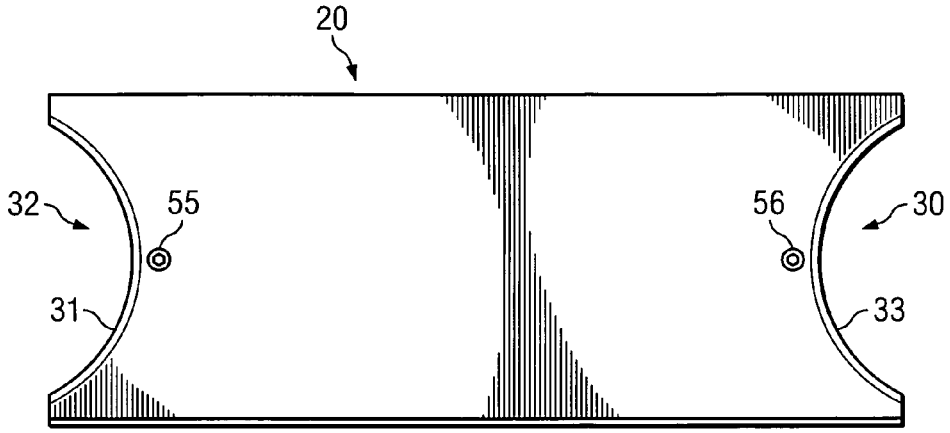
FIG. 9 is a bottom view of the keyboard tray.

FIG. 3 is an exploded view of the various components of the keyboard and mouse tray assembly 10, according to an embodiment of the invention. The right mouse tray 22 and the left mouse tray 24 are shown spaced apart, as they would be when mounted to respective chair upright arm supports 29 and 28. The keyboard tray 20 is shown situated above the plane of the right and left mouse trays 22 and 24 so that it can be lowered onto the upwardly extending lips 46 and 48. As noted above, the keyboard tray 20 is formed with downwardly depending lips 31 and 33 located around each of the semicircular cutouts 30 and 32. This is also shown in FIG. 9. It can be seen that the downwardly depending lips 31 and 33 of the keyboard tray 20 engage with the inner surfaces of the respective upwardly extending lips 46 and 48 of the mouse trays 22 and 24. With this arrangement, the keyboard tray 20 is engaged in a stable manner and spans the spaced-apart mouse trays 22 and 24. By utilizing engagement between the semicircular downwardly depending keyboard lips 31 and 33 with the respective semicircular upwardly extending mouse tray lips 46 and 48, the keyboard tray 20 cannot move laterally in any direction. The keyboard tray 20 can, however, be lifted out of engagement with the opposing mouse trays 22 and 24 to provide access by a user to the chair 12 to which the keyboard and mouse tray assembly 10 is attached. As will be described below, the mouse trays 22 and 24 can be rotationally adjusted to provide the appropriate spacing therebetween to provide suitable engagement with the keyboard tray 20.

The mouse trays 22 and 24 are molded from plastic to provide the upwardly extending lips 46 and 48, as described above. On the user side of the mouse trays 22 and 24, the lips 46 and 48 have a reduced height, i.e., wrist depressions, at respective locations 50 and 52. The reduced height lips 50 and 52 allow easy access by a user's wrists to the articles placed on the mouse trays 22 and 24. As noted above, right-hand users can place the mouse 25 on the right-hand mouse tray 22, and left-hand users can place the mouse 25 on the left-hand tray 24. To be described in more detail below, each mouse tray 22 and 24 includes a respective notch 54 and 56 formed in the upwardly extending lips 46 and 48 for hanging of the keyboard tray 20 therefrom. The keyboard tray 20 has fastened on the underside thereof corresponding hang knobs 55 and 56, the top ends of which are partially shown in FIG. 3 and fully shown in the bottom view of FIG. 9. The hang knob 56 can be engaged with the notch 54 of mouse tray 22 to hang the keyboard tray 20 on the right-hand side of the keyboard and mouse tray assembly 10. Similarly, hang knob 55 can be engaged with the notch 56 of mouse tray 24 to hang the keyboard tray 20 on the left-hand side of the keyboard and mouse tray assembly 10. A number of notches can be formed in the upwardly extending lips 46 and 48 to allow the keyboard tray 20 to be hung at various locations on the respective mouse trays 22 and 24.

Figure 4:
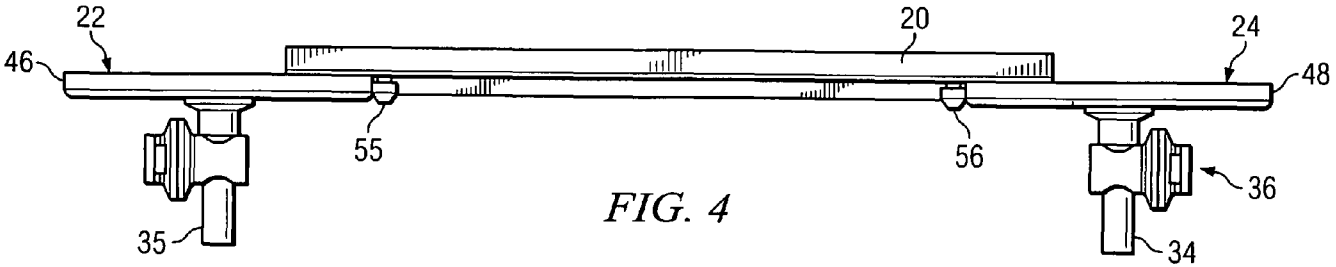
FIG. 4 is a frontal view of the keyboard and mouse tray assembly.
Figure 8:
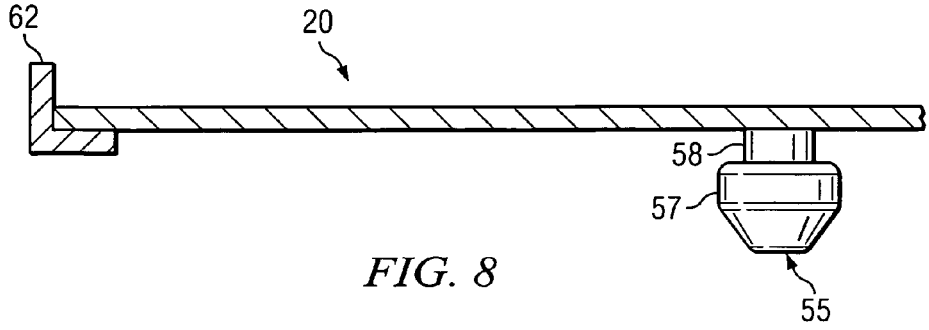
FIG. 8 is a partial sectional view of the keyboard tray illustrating the hang knob.

FIG. 8 is a cross-sectional view of a portion of the keyboard tray 20 illustrating the structural features of the hang knob 55, it being realized that the other hang knob 56 is similarly constructed. The hang knob 55 includes an enlarged end 57 connected to the underside of the keyboard tray 20 by a thinned shaft 58. The shaft 58 can be constructed with a threaded bore so that a flat-head screw can be passed through a hole in the keyboard tray 20 from the top and screwed into a threaded bore of the shaft 58. The hang knob 55 can be formed of a metal or plastic. The thinned shaft 58 portion of the hang knob 55 can be engaged within the notch 56 of the mouse tray 24 and suspended therefrom. It is understood that the keyboard tray 20 can also be hung from the other mouse tray 22 using the hang knob 55 and the notch 54. The hang knob 55 is spaced from the adjacent downwardly depending rib 31 a short distance to allow the upwardly extending rib 46 of the mouse tray 22 to be nestled therebetween. With this nestled arrangement, the lateral movement of the keyboard 20 is limited. The hang knobs 55 and 56 are shown in FIG. 4 close to the respective upwardly extending ribs 46 and 48 of the mouse trays 22 and 24.

A frontal support 60, illustrated in FIG. 3, is attached to the front of the keyboard tray 20 to provide an upwardly extending lip to keep articles, including the keyboard 26, from being pushed off of the tray 20. Similarly, a rear support 62 is attached to the back edge of the keyboard tray 20 to provide a downwardly depending strip. The supports 60 and 62 can be attached to the keyboard tray 20 by bonding the parts together. The supports 60 and 62 can also be formed integral with the keyboard tray 20 during the molding process. The supports 60 and 62 can be made of a shiny metal to provide a pleasing and aesthetic appearance or trim to the keyboard tray 20. The metal strip supports 60 and 62 also make the keyboard tray 20 more rigid.

Figure 5:
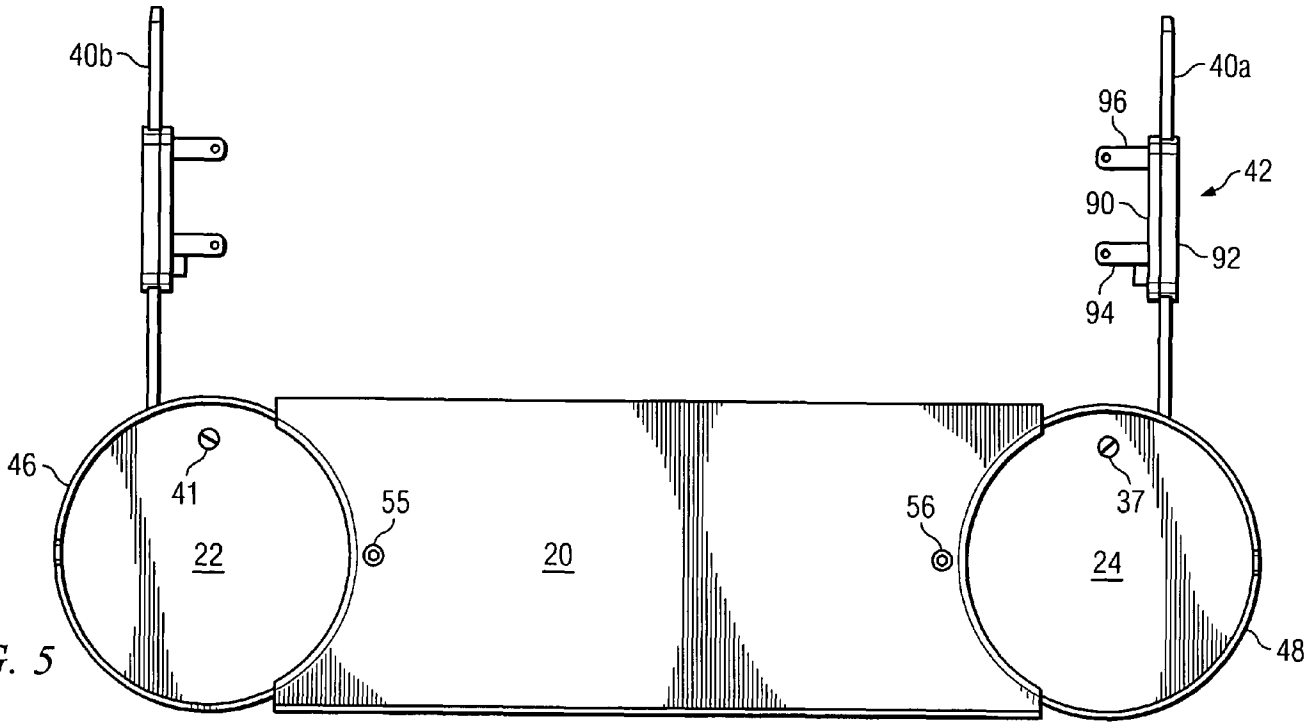
FIG. 5 is a top plan view of the keyboard and mouse tray assembly.
Figure 6:
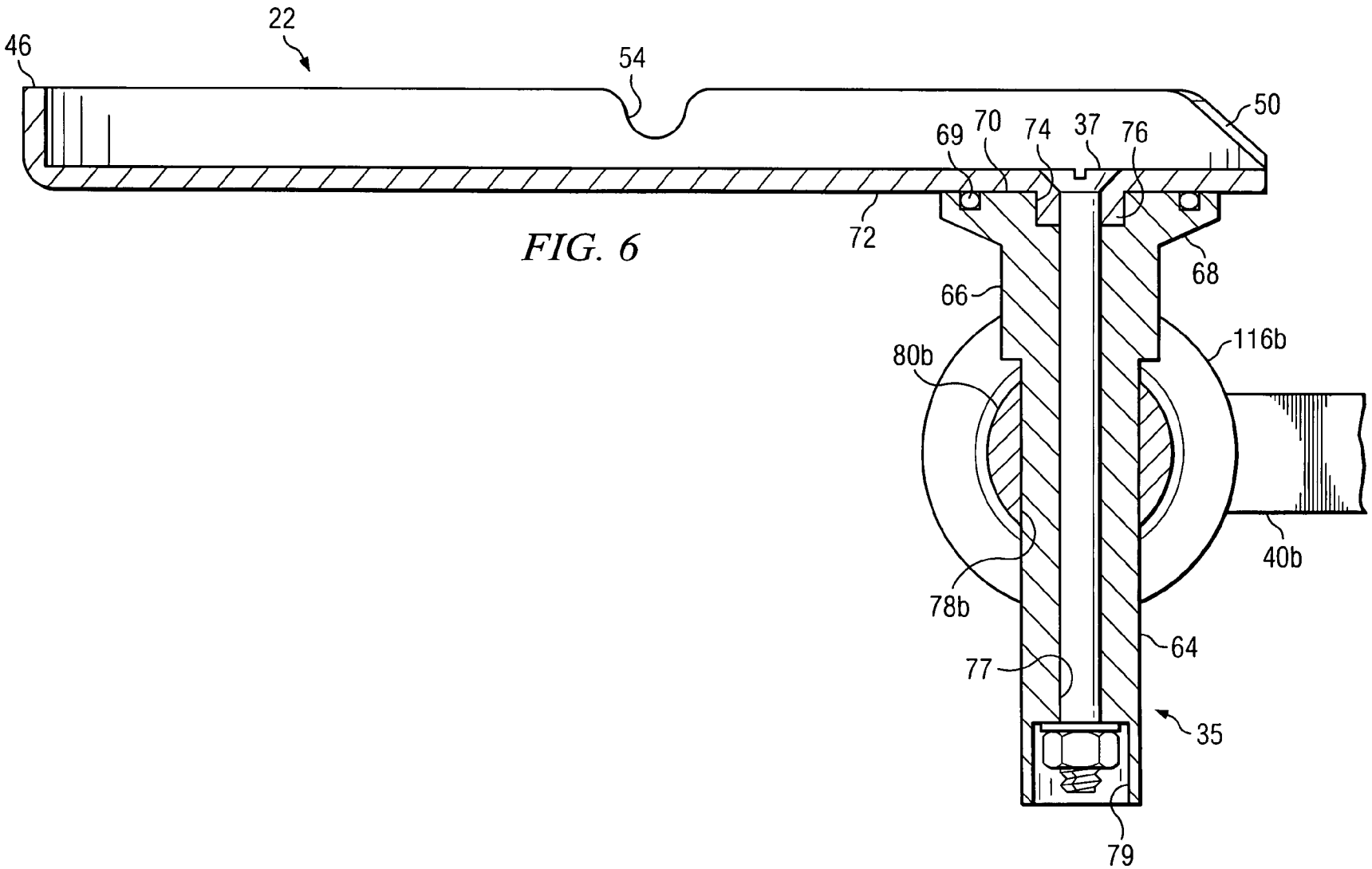
FIG. 6 is a sectional view of the right mouse tray.
Figure 7:
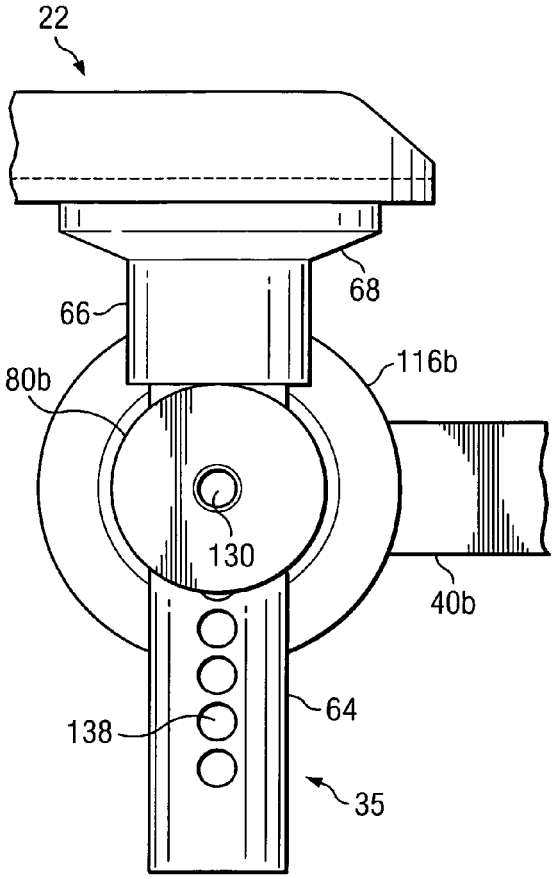
FIG. 7 is a side view of the mouse tray adjustment mechanism.

Reference is now made to FIGS. 3-7 and 10, which illustrate the details of the manner in which the mouse trays 22 and 24 can be attached to the horizontal support arms 40*a* and 40*b*. FIG. 6 illustrates a sectional view of the right mouse tray 22, with the downwardly depending metal stub 35. The stub 35 includes a reduced diameter bottom portion 64 and a larger diameter top portion 66. The top portion 66 is flared out 68 and has a top planar surface 70 that engages the bottom surface 72 of the mouse tray 22. A friction washer or o-ring 69 can be placed between the planar surface 70 of the stub 35 and the bottom surface of the mouse tray 22 to control rotation of the mouse tray 22 with the long screw 37. Formed in the top surface 70 of the stub 35 is a recessed bore 74 that receives therein a protruding part 76 of the tray bottom 72. The stub 35 is thus registered with a particular location of the mouse tray 22. In practice, the stub 35 is located at an offset position 41 (FIG. 5) with respect the bottom circular surface of the right mouse tray 22. The stub 35 has a bore 77 therethrough for allowing a long screw 37 to be passed therethrough from the top of the mouse tray 22. The head of the long screw 37 is shouldered for fitting within a square portion of the mouse tray hole. The mouse tray 22 is thus fixed for rotation with the long screw 37. A self-locking threaded nut can be placed in the bottom recess 79 of the bore 77 and screwed onto the long screw 37. When the mouse tray 22 is rotated, the long screw 37 rotates with it. A friction o-ring 69 can be fitted within an annular groove formed in the top planar surface 70 of the flared portion 68 of the stub 35. When squeezed, the o-ring provides sufficient friction to allow the mouse tray 22 to be rotated in a controlled manner.

The thinned portion 64 of the mouse tray stub 35 is insertable into a bore 78*b* of a tray support 80*b*. The horizontal support arm 40*b* is fastened to the upright support 29 of the chair arm 14 by way of the bracket fixture 42*b*. The stub 35 of the right mouse tray 22 can be moved vertically to adjust the mouse tray 22 to a desired elevation. When the right mouse tray 22 is adjusted by the user to the desired elevation, the knob 39 can be manually tightened to secure the tray stub 35 within the tray support 80*b* to prevent further inadvertent movement of the mouse tray 22. The left mouse tray 24 is similarly fastened to a corresponding mechanism 80*a*.

Figure 10:
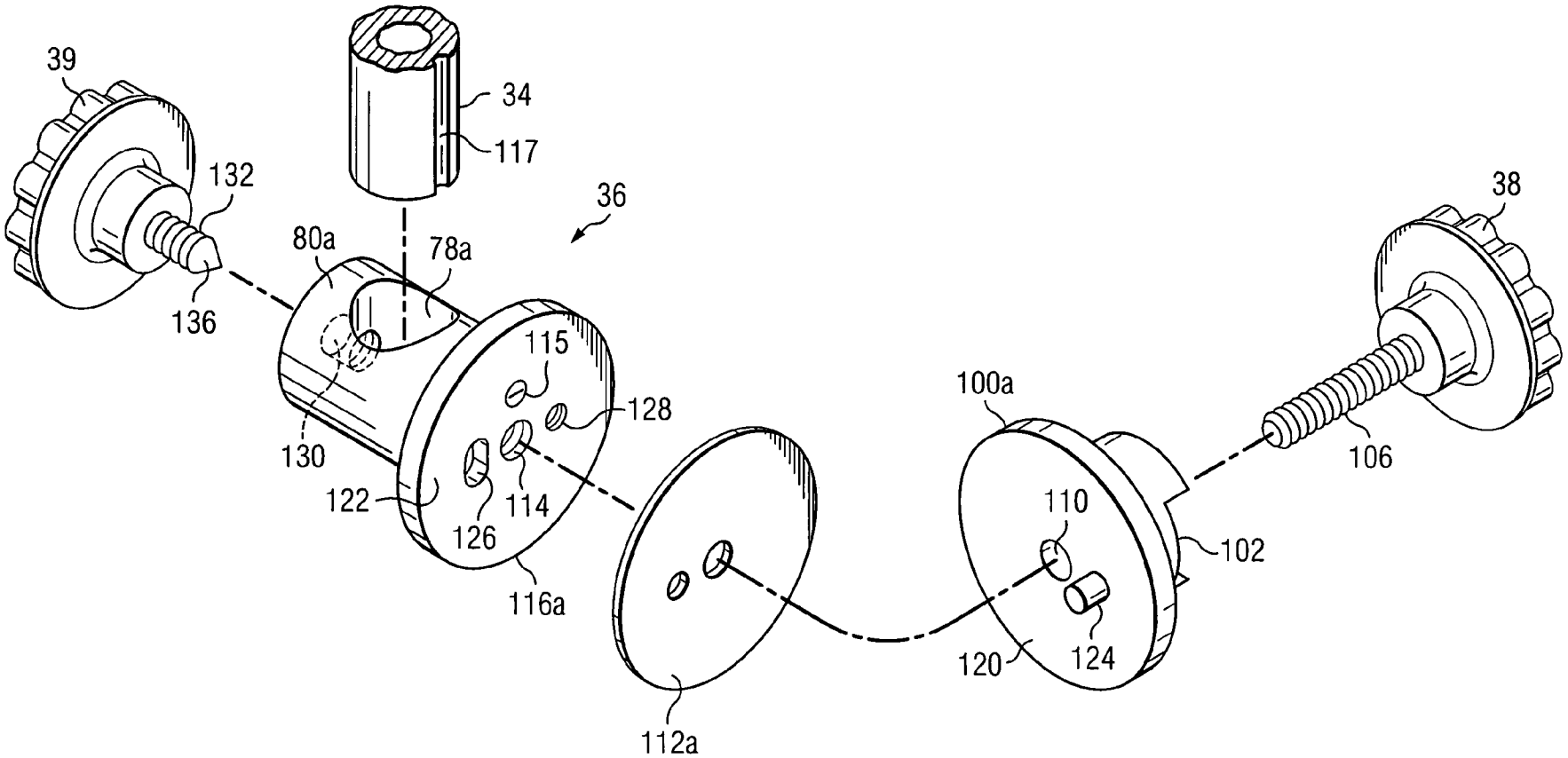
FIG. 10 is an exploded view of the parts of the adjustment mechanism for fastening a mouse tray to a horizontal support arm.

With regard to FIGS. 3 and 10, there are illustrated the additional details of the mechanism for mounting the left mouse tray 24 to the respective horizontal support arm 40*a*. The mounting apparatus includes a slotted clamp member 100*a* constructed with an open slot 102 for receiving the horizontal arm 40*a* therein. The outside knob 38 has a threaded screw 106 that can be passed through the hole 108 in the end of the horizontal support arm 40*a* and through the bore 110 in the slotted clamp member 100*a*, through a cork friction gasket 112*a* and into a threaded bore 114 of an opposing stub-receiving member 116*a*. A hard rubber washer 118*a* can be inserted between the outside knob 38, on the threaded screw 106, and the horizontal support 40*a*.

The thinned section 64 of the left mouse tray stub 34 extends through the bore 78*a* of the tray support 80*a*. The tray support 80*a* is constructed integral with the stub-receiving member 116*a*. As an alternative to the friction cork gasket 112*a*, the planar face 122 of the stub-receiving member 116*a* can have a circular groove formed therein for receiving an o-ring to provide friction for movement between the slotted clamp member 100*a* and the stub-receiving member 116*a*. Extending from the planar face 120 of the slotted clamp member 100*a* is a pin 124 that can be inserted into two receptacles, depending on how it is desired for the mouse tray 24 to be tilted forwardly or backwardly, with respect to the user sitting in the chair 12. The stub-receiving member 116*a* has formed in the planar face 122 an arcuate hole 126 spanning about 0-20 degrees, and most preferably about 10-15 degrees. A circular hole 128 is also formed in the planar face 122. When the slotted clamp member 100*a* and the stub-receiving member 116*a* are assembled together with the pin 124 inserted into the round hole 128, the stub-receiving member 116*a*, and thus the mouse tray 24, cannot be pivoted back and forth. Alternatively, if the slotted clamp member 100*a* is rotated 180 degrees, and the pin 124 is inserted into the arcuate hole 126, the stub-receiving member 116*a* can be pivoted forwards and backwards a corresponding amount, until the pin 124 abuts each end of the arcuate hole 126. The arcuate hole 126 is preferably formed so that the mouse tray 24 can pivot from a horizontal level to a position where the frontal portion of the mouse tray 24 is tilted downwardly with respect to the rear portion, about 10-15 degrees, or thereabouts. This is an efficient ergonomic position in which the user's wrist can manipulate the mouse 25 without undue stress on the tissues of the wrist.

Rather than using a round hole 128, a second arcuate hole can be formed in the planar face 122 of the stub-receiving member 116*a*. The second arcuate hole can provide a greater or lesser degree of pivotal movement of the mouse tray 24 as compared to that of the first arcuate hole 126.

As noted above, the tray support 80*a* includes a bore 78*a* for receiving therethrough the reduced diameter portion 64 of the left mouse tray stub 34. The tray support 80*a* further includes a lateral threaded bore 130 therein for receiving the threaded portion 132 of the inside vertical adjustment knob 39. The end 136 of the threaded part 132 is pointed and fits within one of the plural indentions 138 of the mouse tray stub 34, shown in FIG. 7. With this arrangement, the mouse tray 24 can be adjusted vertically in increments, based on the spacing of the indentions 138. The tightening of the vertical adjustment knob 39 to force the pointed end 136 into one of the indentions 138 prevents both upward/downward and rotational movement of the mouse tray stub 34.

As noted above, each mouse tray 22 and 24 is securely mounted to a respective chair arm 14 and 16 by associated horizontal supports 40*b* and 40*a*. FIGS. 3 and 5 illustrate the mounting apparatus for mounting the keyboard and mouse tray assembly 10 to respective arms of the chair 12. As described above, the horizontal supports 40*a* and 40*b* are fastened to the respective mouse tray stub mounting apparatus shown in FIGS. 6, 7 and 10. The horizontal support 40*a* is slideable within chair mounting bracket fixture 42*a*. The other chair mounting bracket 42*b* is fabricated in a similar manner. The chair mounting bracket fixture 42*a* is constructed in two halves, each half having a half-width slot formed therethrough so that when assembled together there exists a rectangular slot through which the rectangular-shaped horizontal support arm 40*a* is slideable. The halves 90*a* and 92*a* are attached together with screws, not shown. The saddle bracket half 90*a* includes a pair of spaced-apart ears 94 and 96 formed orthogonally to side of the saddle bracket 90*a*. The saddle bracket 90*a* straddles the top portion of the upright arm support 28. The ears 94 and 96 each have a vertical bore therethrough, through which a respective screw extends for fastening the bracket fixture 42*a* to the upright arm support 28. In practice, the bracket fixture 42*a* is well adapted for fastening the horizontal support to BodyBilt 4-Arm office chairs manufactured by ErgoGenesis, LLC., of Navasota, Tex. Such bracket fixtures 42*a* and 42*b* are also easily adapted for fitting to the Aeron type office chair, and others. In these types of chair, the two existing screws are removed that attach the arm 16 to the top portion of the upright support 28. Then, longer screws are used to fasten the bracket fixture 42*a* through the upright arm support 28 and into the bottom of the arm rest 16. The bracket fixture 42*a* is thus firmly and rigidly attached to the upright arm support 28. The other bracket fixture 42*b* is similarly attached to the other upright arm support 29.

Returning to FIG. 10, it can be seen that the rotation of the mouse tray stub 34 is further prevented by the utilization of a vertical groove 117 formed in the thinned portion 64 of the stub 34, and a spring-loaded detent that is urged into the groove 117. Formed in the planar face 122 of the stub-receiving member 116*a* is a threaded bore with a spring detent mechanism 115 screwed therein. The spring-loaded detent is nylon tipped (not shown) so that the tip extends into the bore 78*a* and is pressed into the vertical groove 117 of the mouse tray stub 34. The tip of the spring detent mechanism 115 prevents the stub 34 of the mouse tray 24 from rotating. As noted above, the mouse tray 24 is itself rotatable with the long screw 37 within the stub apparatus.

Figure 11:
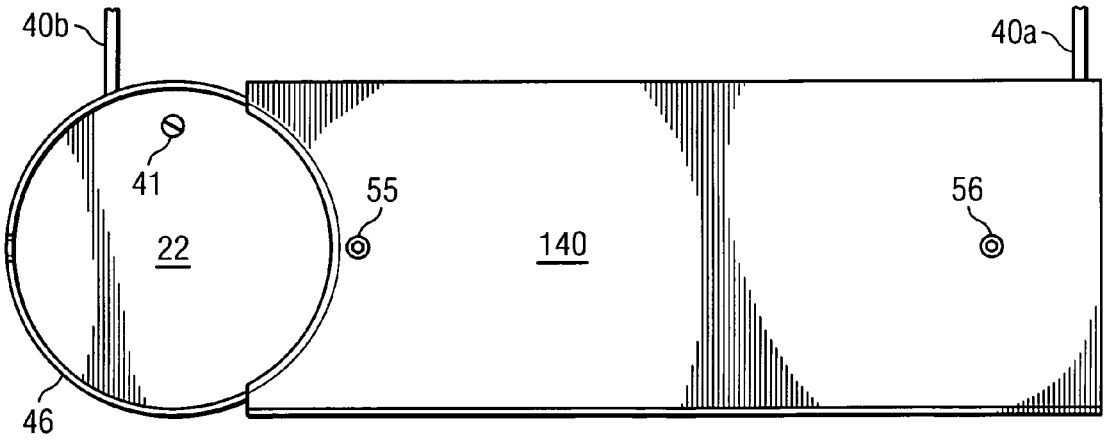
FIG. 11 is a top view of another embodiment of the invention which includes a single mouse tray engaged with the keyboard tray.

While the preferred embodiment of the invention utilizes two mouse trays, this arrangement is not necessary. In certain circumstances, it may be desired to construct the assembly with a single mouse tray, as illustrated in FIG. 11. In this instance, the right mouse tray 22 would be connected to the horizontal support 40*b* in the same manner described above. The other horizontal support 40*a* would be constructed with an upwardly extending lip attached thereto, and the keyboard tray 140 would have a straight left side edge with a downwardly depending lip which would engage with the upwardly extending lip of the support arm 40*a* in the same manner as set forth above. The engaging lips could have an irregular shape to prevent movement of the parts in a horizontal plane. In this embodiment, the lateral length of the keyboard tray could be longer to accommodate the absence of the left mouse tray. The keyboard tray and mouse tray assembly illustrated would be for a right-hand user, but the assembly could be constructed in a similar manner for left-hand users.

Figure 12:
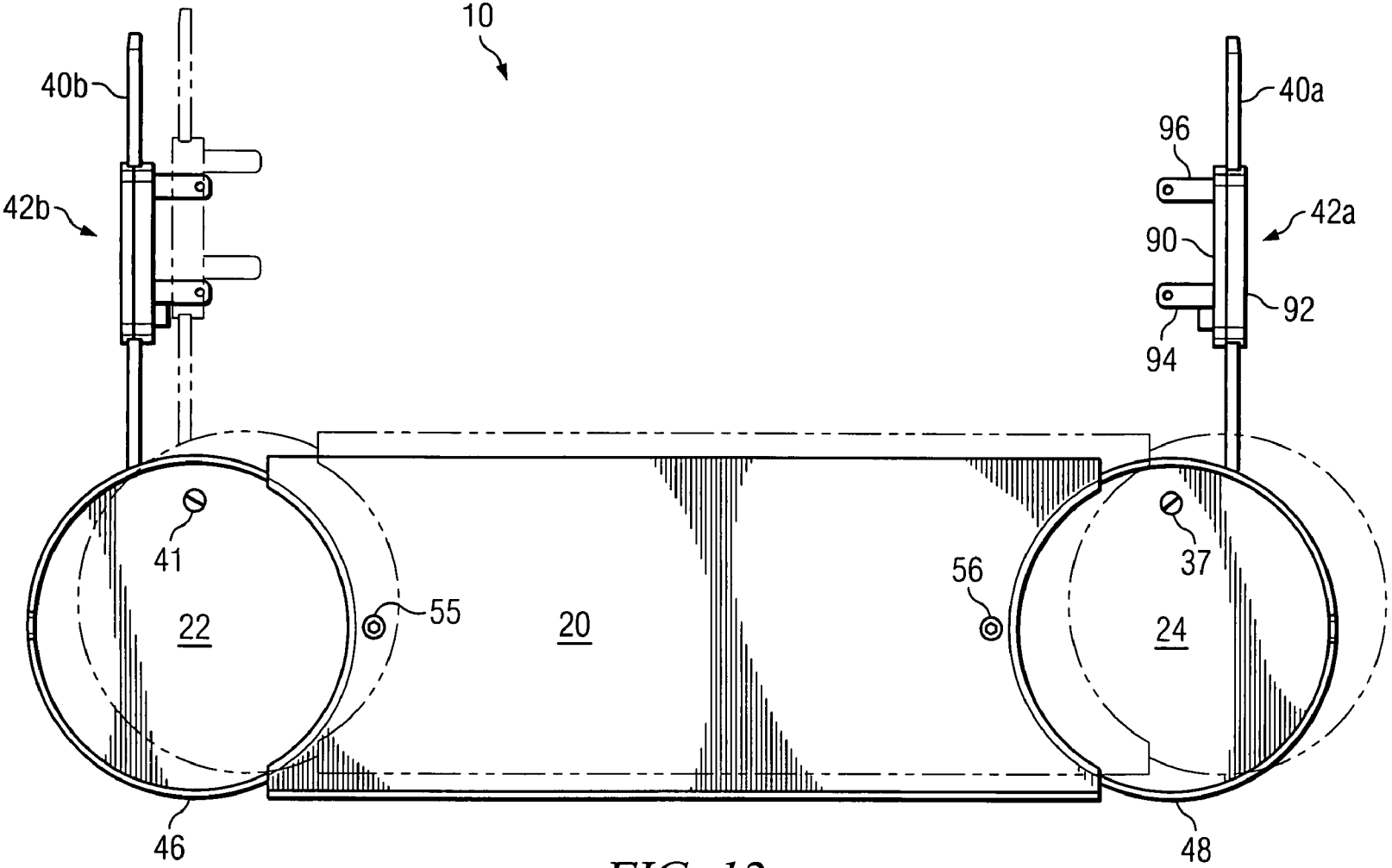
FIG. 12 is a top view of the keyboard and mouse tray assembly, showing the adjustability of the mouse trays to accommodate different width chairs.

FIG. 12 illustrates another feature of the keyboard and mouse tray assembly 10. Here, the adjustability of the mouse trays 22 and 24 is shown, to allow rotation thereof about the respective offset rotational axes 37 and 41. This adjustment allows the horizontal support arms 40*a* and 40*b* to be closer together, as shown in broken lines, and accommodate a chair with arms closer together. This is accomplished by rotating the left mouse tray 24 about the long screw at position 37, from the position shown in solid lines, to the position shown in broken lines. Similarly, the right mouse tray 22 is also rotated about the long screw at position 41, from the position shown in solid lines, to the position shown in broken lines. Both mouse trays 22 and 24 can be rotated to the left (from the perspective of a user sitting in the chair), as shown, whereby the right horizontal support arm 82 is moved closer to the left horizontal support arm 40*a*. In this manner, the keyboard and mouse tray assembly 10 can be installed in a chair with arms or upright arm supports that are closer together. While the illustration of FIG. 12 shows that both mouse trays 22 and 24 are rotated, in other instances it may be necessary to only rotate one mouse tray to achieve the desired spacing between the mouse trays 22 and 24. In addition, when one or more mouse trays 22 and 24 are rotated, it may be necessary to adjust the horizontal support arms 40*a* and 40*b* in the respective bracket fixtures 42*a* and 42*b* to position the keyboard tray 20 at the desired location.

Figure 13:
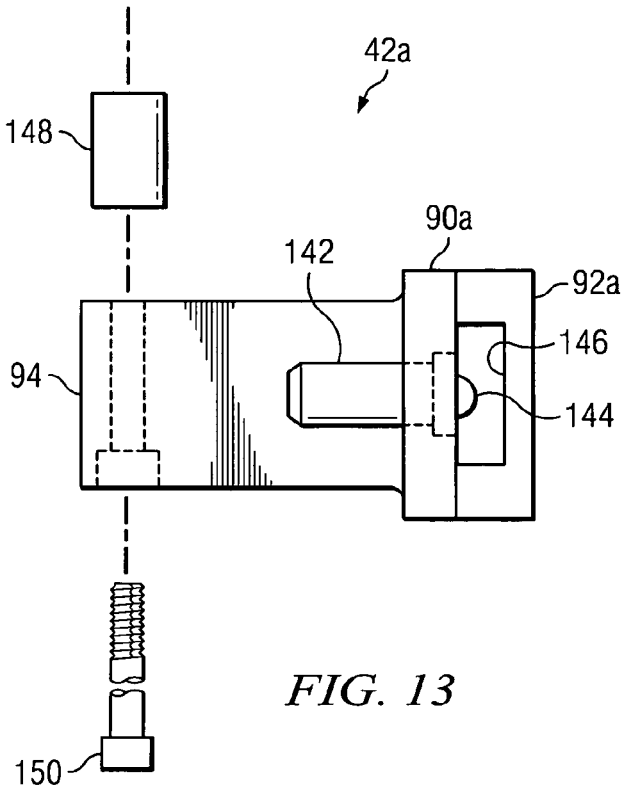
FIG. 13 is an front end view of the bracket fixture through which the horizontal support arm is slideable adjustable.
Figure 14:
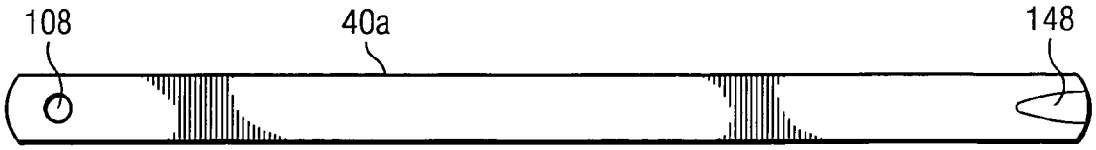
FIG. 14 is a side view of a horizontal support arm.

FIGS. 13 and 14 illustrate another feature of the horizontal support arm and bracket fixture 42*a* arrangement. Fixed within the saddle bracket half 90*a* is a spring-loaded ball mechanism 142 having a nylon ball 144 that extends into the rectangular slot 146. When the horizontal support arm 40*a*, shown in FIG. 14, is in the slot 146 of the bracket fixture 42*a*, the spring loaded ball 144 urges against the side of the horizontal support arm 40*a* and thus provides a sufficient degree of friction. Thus, the horizontal support arm 40*a* requires manual pushing or pulling in order to move the support arm 40*a* through the bracket fixture 42*a* for adjustment thereof. As noted above, the horizontal adjustment of the support arm 40*a* in and out of the bracket fixture 42*a* is effective to move the keyboard and mouse tray assembly 10 toward or further away from the user. Indeed, for easy removal of the entire keyboard and mouse tray assembly 10 from the chair 12, the horizontal support arms 40*a* and 40*b* can be entirely removed from the respective bracket fixtures 42*a* and 42*b*. In order to facilitate reinsertion of the horizontal support arms 40*a* and 40*b* into the respective bracket fixtures 42*a* and 42*b*, the end of each support arm 40*a* and 40*b* is constructed with an elongate groove 148 that is deep at the end of the support arm 40*a*, and tapers to a point where the groove 148 ceases to exist. A similar groove 148 is formed on the other side of the horizontal support arm 40*a*, both at the same end thereof. The groove 148 allows the support arm 40*a* to be pushed into the rectangular slot 146 of the bracket fixture 42*a* to initially depress the ball 144 during sliding movement, and thus prevents the ball 144 from initially abutting against an otherwise blunt end of the support arm 40*a*. The bracket fixture 42*a* can be fastened to the upright arm support 28 using a tubular spacer 148 and a longer screw 150. The long screw 150 is inserted through a bore in the ear 94 of the saddle bracket 90*a*, through the tubular spacer 148, through an upper portion of the upright support 28, and then into a threaded part of the bottom of the arm rest 16. The other ear 96 of the saddle bracket 90*a* is similarly fastened to the arm rest 16.

From the foregoing, disclosed is a keyboard and mouse tray assembly adapted for mounting to a chair. In a preferred embodiment, two mouse trays are mounted by way of horizontal arms to the respective upright supports of a chair. The spaced-apart mouse trays each have an upright extending lip. The keyboard tray spans the distance between the mouse trays and can be lowered thereon so that a downwardly depending lips of the keyboard tray engages with the respective upwardly extending lips of the mouse trays. The keyboard tray is constructed with a hang knob fixed to a bottom surface thereof. When the user desires to enter or exit the chair, the keyboard tray and the keyboard attached thereto, can be lifted up from engagement with the spaced-apart mouse trays and placed in a stowed position. The stowed position of the keyboard tray is where the keyboard tray is suspended from one of the mouse trays, with the hang knob engaged within a notch formed in the upwardly extending lip of the mouse tray. Moreover, the user can remove the keyboard tray (and keyboard attached thereto) and carry the same to another location, if desired. Indeed, a user can have multiple chairs equipped with tray mounting apparatus, and carry the keyboard tray and keyboard attached thereto to any of the chairs to work on different computers.

It can be appreciated that the mouse trays are fully and independently adjustable to various tilt positions to achieve an ergonomically efficient condition for the continued use of a mouse or other item. Moreover, each mouse tray is adjustable vertically which, together with the tilt position adjustment, provides an easy means to ergonomically position the mouse trays with respect to the arm rests of the chair. In addition, the mouse trays are rotatable to position the keyboard tray at various locations in front of the chair. In terms of adjustability, the keyboard and mouse tray assembly can be adjustable forwardly and backwardly by slideable adjustment of horizontal support arms within the bracket fixtures fastened to the chair arm upright supports. Lastly, the keyboard and mouse tray assembly can be easily removed from the bracket fixtures fastened to the chair upright supports should the use of the entire assembly be temporarily unnecessary.

In addition to the foregoing, it is not necessary that the keyboard tray engage with the mouse trays using upwardly extending and downwardly depending lips. Many other engaging relationships can be utilized to permit the trays to be engaged together to prevent lateral movement therebetween, but yet allow the upward removal of the keyboard tray from the mouse trays. For example, the undersurface of the keyboard tray could be molded with a post at each end, where the post engages within a respective socket formed in the mouse trays. Alternatively, the post and sockets could be reversed and thus formed on the other trays. Similarly, the hang knobs could be formed extending laterally from the mouse trays, and notches formed on the undersurface of the keyboard tray to thus allow the keyboard tray to be placed in the stowed position. As can be appreciated, the preferred embodiment of the invention does not require the various components to be constructed in the same manner or function in the exact manner described.

The mouse trays are described as being formed as circular plate-like structures. However, this shape is merely illustrative, as the shape of the mouse trays could be other than circular, such as oval, rectangular, square, kidney-shaped, etc. Indeed, each mouse tray could be shaped differently. For example, a cup holder or tablet holder could be used in place of one mouse tray, where the keyboard tray engages with the cup or tablet holder. The cutouts in the keyboard tray would preferably match the shape of at least a portion of the mouse tray, cup holder, tablet holder, telephone holder, CD holder, etc. For a mouse tray, a special material could be used as a covering on the top surface thereof to provide the required rolling friction to the ball of the mouse.

While the preferred and other embodiments of the invention have been disclosed with reference to a specific keyboard and mouse tray, and associated methods of construction and use thereof, it is to be understood that many changes in detail may be made as a matter of engineering choices without departing from the spirit and scope of the invention, as defined by the appended claims.

What is claimed is:

1. Computer accessory tray apparatus mountable to a chair, said computer accessory tray apparatus adapted for holding a computer keyboard and a computer mouse, said computer accessory tray apparatus comprising:

a keyboard tray adapted for holding the computer keyboard thereon;

a left accessory tray and a right accessory tray, at least one said accessory tray adapted for holding the computer mouse thereon;

a first horizontal arm for supporting said left accessory tray to the chair, and a second horizontal arm for supporting the right accessory tray to the chair;

said keyboard tray having one end structured for removable engagement with said left accessory tray and another end of said keyboard tray structured for removable engagement with said right accessory tray so that said keyboard tray is supported at opposing ends to prevent substantial sideway movement of said keyboard tray toward or away from said first and second horizontal arm, but said keyboard tray is constructed to be lifted to remove it from engagement with said left and right accessory trays without also lifting the right and left accessory trays; and whereby said keyboard tray can be lifted and removed from said left and right accessory trays and moved out of the way to allow entry to or exit from the chair by a user of said computer accessory tray apparatus.

2. The computer accessory tray apparatus of claim 1, wherein said left and right accessory trays include respective upwardly extending members, and said computer keyboard tray includes a downwardly depending members on opposite sides thereof, and wherein said respective upwardly extending and said downwardly depending members laterally engage each other and are disengaged by lifting the keyboard tray upwardly.

3. The computer accessory tray apparatus of claim 2, wherein the upwardly extending members of said left and right accessory trays comprise respective lips, and the downwardly depending members comprise respective lips of said computer keyboard tray that are located on opposite edges thereof.

4. The computer accessory tray apparatus of claim 3, wherein at least one said accessory tray is circular shaped, and said upwardly extending lip is located at least partially around a circular edge of said at least one accessory tray, and said computer keyboard tray has opposing front and back sides, and a partial circular cutout on each opposing left and right end thereof, and each said downwardly depending lip is located on a respective opposing edge having said partial circular cutout.

5. The computer accessory tray apparatus of claim 1, wherein said computer keyboard tray and at least one said accessory tray both include laterally engaging members to prevent movement in at least a first lateral direction of said computer keyboard tray with respect to said one accessory tray, and wherein said computer keyboard tray further includes a member attached thereto for preventing lateral movement of said computer keyboard tray with respect to said one accessory tray in a second lateral direction opposite to said first lateral direction.

6. The computer accessory tray apparatus of claim 5, wherein said member attached to said computer keyboard tray comprises a hang knob adapted for allowing said computer keyboard tray to be suspended from said one accessory tray by said hang knob.

7. The computer accessory tray apparatus of claim 6, wherein said one accessory tray includes an upwardly extending lip engageable with a downwardly extending lip of said computer keyboard tray, and wherein said upwardly extending lip of said one accessory tray includes a notch formed therein, and said hang knob is engageable in said notch when said computer keyboard tray is suspended from said one accessory tray.

8. The computer accessory tray apparatus of claim 1, wherein said left and right accessory trays further include a respective downwardly depending mounting stub mounted thereto at an offset position, and said left and right accessory trays are rotatable about said respective mounting stubs.

9. The computer accessory tray apparatus of claim 1, wherein each said left and right accessory tray is circular-shaped and includes an upwardly extending lip formed substantially around a peripheral edge thereof, and further including at least one notch formed in each said upwardly extending lip, and wherein each said upwardly extending lip is constructed with a given height except for a reduced height along a portion of the peripheral edge to allow easy access to an item located on a top surface of each said accessory tray.

10. The computer accessory tray apparatus of claim 1, wherein said each first and second horizontal arm is adapted for adjustment forwards and backwards, each said left and right accessory tray is adapted for adjustment vertically, and each said left and right accessory tray is adapted for tilting about a horizontal axis orthogonal to a longitudinal axis of a respective said first or second horizontal arm.

11. A computer accessory tray apparatus mountable to a chair, said computer accessory tray apparatus adapted for holding a computer keyboard, said computer accessory tray apparatus comprising:

a keyboard tray adapted for holding the computer keyboard thereon;

a first tray and a second tray, each said first and second tray adapted for holding respective items thereon, each said first and second tray having respective vertical members, and each said first and second tray adapted for rotation about respective vertical axes to adjust a spacing therebetween;

a first and second horizontal arm adapted for attachment to the chair, said first tray attached to said first horizontal arm, and said second tray attached to said second horizontal arm;

said keyboard tray having opposing lateral ends, each said opposing lateral end having a respective vertical member, a first opposing end of said keyboard tray removably engaged with said first tray so that said keyboard tray is supported thereon, a second opposing end of said keyboard tray removably engaged with said second tray so that said keyboard tray is supported thereon, and when said first and second opposing ends of said keyboard tray are supported on said first and second trays, the vertical members of said keyboard tray engage with the respective vertical members of said first and second tray to prevent substantial lateral movement of said keyboard tray with respect to said first and second tray, but said keyboard tray can be lifted from engagement with said first tray and said second tray; and whereby said keyboard tray can be removed from said first and second tray to allow entry to or exit from the chair by a user.

12. The computer accessory tray apparatus of claim 11, wherein each said first and second tray is rotatable about a respective vertical axis that is offset from a center of the respective tray.

13. The computer accessory tray apparatus of claim 11, wherein said first and second tray are each circular in shape with respective planar surfaces, and said opposing lateral ends of said keyboard tray includes respective partial circular cutouts.

14. The computer accessory tray apparatus of claim 13, wherein the vertical member of each said first and second trays comprise a respective upwardly extending lip, and each vertical member of said keyboard tray comprises a downwardly depending lip located on each said partial circular cutout, and said downwardly depending lips engage respective said upwardly extending lips of said first and second trays.

15. The computer accessory tray apparatus of claim 11, wherein said first and second horizontal arms are each adapted for adjustment forwards and backwards, said first and second trays are each adapted for adjustment vertically, and each said first and second tray is adapted for tilting about a respective horizontal axis orthogonal to a longitudinal axis of said horizontal arm.

16. A computer accessory tray apparatus adapted for mounting to arms of a chair, comprising:

a first and second horizontal support arm, each said support arm having respective first and second ends;

a respective accessory tray mounted to the first end of each said first and second horizontal support arm;

a first bracket fixture fixed to a first arm of the chair so as to be rigidly fixed thereto, said first bracket fixture having a slot therein adapted for slideably receiving therein said first horizontal support arm, and where said first horizontal support arm can be slideably removed from said first bracket fixture;

a second bracket fixture fixed to a second arm of the chair so as to be rigidly fixed thereto; said second bracket fixture having a slot therein adapted for slideably receiving therein said second horizontal support arm, and where said second horizontal support arm can be slideably removed from said second bracket fixture; and a friction mechanism located in the respective slots of said first and second bracket fixtures to provide sliding friction to movement of the first and second horizontal support arms when moved within the respective first and second bracket fixtures.

17. The computer accessory tray apparatus of claim 16, wherein said friction mechanism comprises a spring-loaded member urged against at least one side of each said first and second horizontal support arm.

18. Computer accessory tray apparatus mountable to a chair, said computer accessory tray apparatus adapted for holding a computer keyboard and a computer mouse, said computer accessory tray apparatus comprising:

a keyboard tray adapted for holding the computer keyboard thereon;

an accessory tray adapted for holding the computer mouse thereon;

a first horizontal arm for supporting said accessory tray to the chair, and a second horizontal arm for supporting one end of the keyboard tray to the chair;

said keyboard tray having one end structured for removable engagement with said accessory tray and another end structured for removable engagement with said second horizontal arm so that said keyboard tray is supported at opposing ends to prevent substantial sideway movement of said keyboard tray toward or away from said first and second horizontal arm, but said keyboard tray is constructed to be lifted to remove it from engagement with said accessory tray and said second horizontal arm without also lifting the accessory tray; and whereby said keyboard tray can be lifted and removed from said accessory tray and from said second horizontal arm and moved out of the way to allow entry to or exit from the chair by a user of said computer accessory tray apparatus.

19. The computer accessory tray apparatus of claim 1, wherein each said left and right accessory tray includes a curved edge with respective upwardly extending lips, and opposing edges of said keyboard tray are curved with respective downwardly depending lips, wherein one downwardly depending lip of said keyboard tray engages with the upwardly extending lip of said left accessory tray, and an opposite downwardly depending lip of said keyboard tray engages with the upwardly extending lip of said right accessory tray.

20. The computer accessory tray apparatus of claim 19, wherein said keyboard tray includes a pair of hang knobs attached to an undersurface thereof, and the respective hang knobs are spaced a short distance from the respective curved downwardly depending lips to allow the respective upwardly extending lips of the accessory trays to be nestled in the respective spaces.

* * * * *